US006994105B1

(12) United States Patent
Chen

(10) Patent No.: US 6,994,105 B1
(45) Date of Patent: Feb. 7, 2006

(54) REFINED PIPE REEL STRUCTURE

(75) Inventor: Feng-Chi Chen, Taichung Hsien (TW)

(73) Assignee: Yeh Hsin Enterprise Co., Ltd., Taichung Hsien (TW)

( * ) Notice: Subject to any disclaimer, the term of this patent is extended or adjusted under 35 U.S.C. 154(b) by 0 days.

(21) Appl. No.: 10/855,311

(22) Filed: May 28, 2004

(51) Int. Cl.
*B65H 75/34* (2006.01)

(52) U.S. Cl. ..... 137/355.16; 242/405

(58) Field of Classification Search ..... 137/366.16, 137/355.26; 242/405
See application file for complete search history.

(56) References Cited

U.S. PATENT DOCUMENTS 2,288,904 A * 6/1942 Ewald ..... 137/355.26
4,543,982 A * 10/1985 Wolfe ..... 137/355.21
4,713,497 A * 12/1987 Smith ..... 191/12.2 R
5,782,412 A * 7/1998 Plantz et al. ..... 239/197
5,857,285 A * 1/1999 Little ..... 43/57.1
5,975,120 A * 11/1999 Novosel ..... 137/355.23
6,588,444 B2 * 7/2003 Paplow et al. ..... 137/15.01
6,792,970 B2 * 9/2004 Lin ..... 137/355.17

* cited by examiner

*Primary Examiner*—A. Michael Chambers
(74) *Attorney, Agent, or Firm*—Egbert Law Offices

(57) ABSTRACT

A modified structure of pipe reel incorporates a main frame, which is provided with a pipe groove to accommodate the water pipe. The first end of the water pipe is placed at the central outlet of the swing frame, while the second end is placed at a preset cross groove at one side of the main frame. There is an outlet limit base provided at the central outlet of the swing frame and a cross-hole is available for connection; and there is a connection base, which is provided within the outlet limit base. The inner end can be connected to the first end of the water pipe, and the outer end can penetrate the cross-hole of the outlet limit base to give shape of a convex provided with a connection end, available with the configurations of water pipe head and sprinkler connector for connection.

5 Claims, 6 Drawing Sheets

REFINED PIPE REEL STRUCTURE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a pipe reel, and more particularly to a pipe reel having a reel plate outlet comprised of a limit base to allow the connection of a pivot set.

BACKGROUND OF THE INVENTION

Generally, the pipe reel is a secondary cleaning tool for wrapping and removing the water pipe in the horticulture. With regard to the structure of typical pipe reel, the outlet and inlet are specifically designed for the connection of hydrants and sprinklers. And, the pipe reel itself is only positioned for the retraction and positioning of the water pipe. Notwithstanding its original intentions of development, the existing pipe reel will be probably phased out from the market in the absence of innovative products. Therefore, this industry shall assume the responsibility of making some pioneering R&D for an innovative structure of pipe reel.

BRIEF SUMMARY OF THE INVENTION

The present invention has offered an improved efficiency as detailed blow:

Based on the special structural design that an outlet limit base is provided at the outlet of the pipe reel's swing frame to allow the connection of the pivot set, the connection end of the connection base can be connected to water pipe head or sprinkler connector. Therefore, the pipe reel can be connected to the water supply system, or integrated into various sprinklers for an improved performance.

The new features of the present invention are as follows:

Thanks to the openable structure of the outlet limit base 40, the outlet limit base 40 can be easily opened for check and maintenance.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
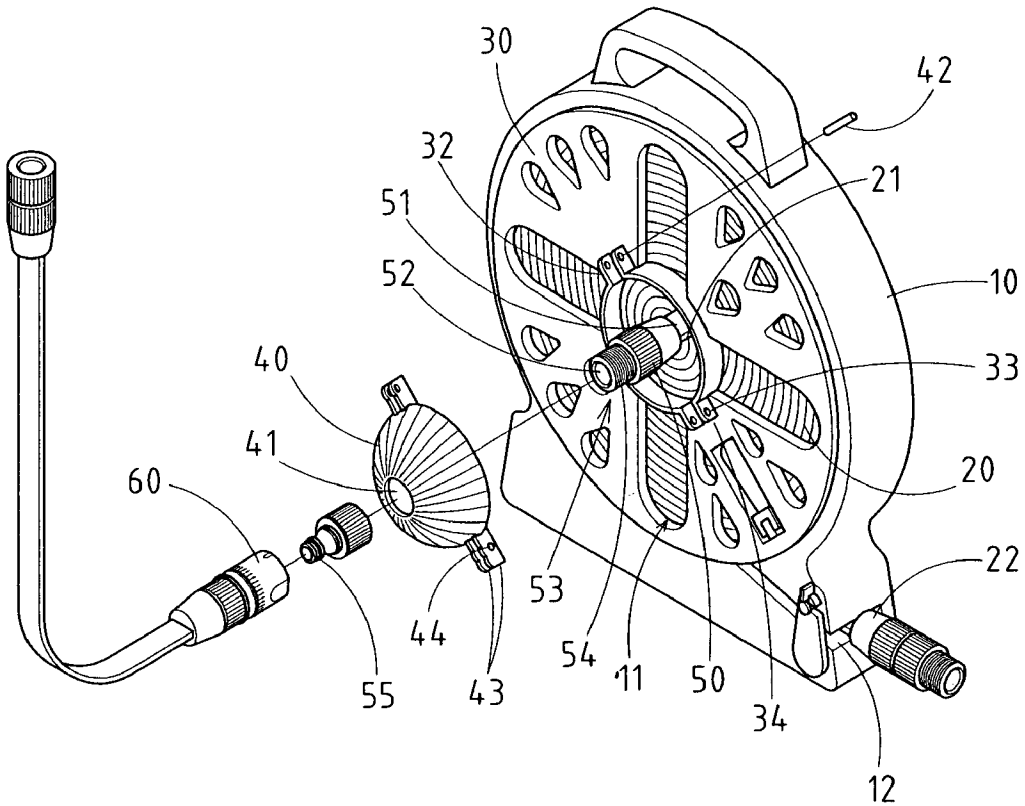
FIGS. 1–2 show exploded perspective views of the preferred embodiment of the present invention.
Figure 2:
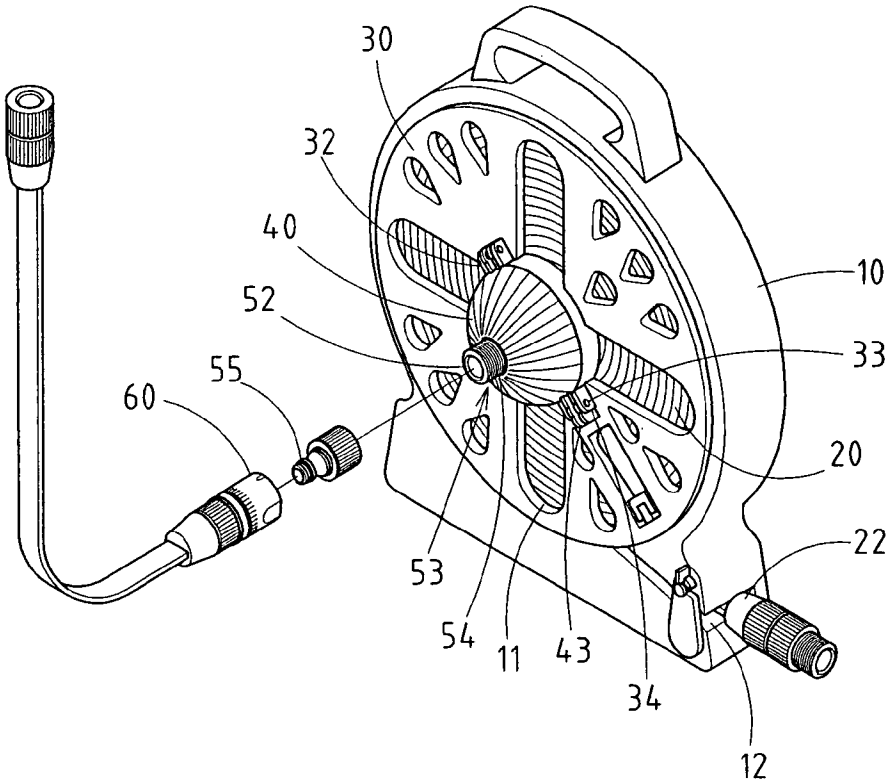

As shown in FIGS. 1–2, a reel is embodied in the present invention.

There is a main frame 10, which is provided with a pipe groove 11 to accommodate the water pipe 20. And, the water pipe 20 can be wrapped onto a swing frame 30. The first end 21 of the water pipe 20 is placed at the central outlet of the swing frame 30, while the second end 22 is placed at a preset cross groove 12 at one side of the main frame 10.

There is also an outlet limit base 40, which is provided at the central outlet of the swing frame 30, and a cross-hole 41 is available for connection.

The present invention also has a connection base 50, which is provided within the outlet limit base 40. The connection base 50 can be designed to provide a L-type pipe form, with its inner end 51 connected to the first end 21 of the water pipe 20, and its outer end 52 penetrating the cross-hole 41 of the outlet limit base 40 to give shape of a convex of a preset length. Then, the convex is provided with a connection end 53, which is available with configurations of an external screw 54, an internal screw (picture unavailable) or a quick connector 55. Certainly, the integrated structure shall be a preferred option. Alternatively, a quick connecter 55 can be added, with its connection end installed by a bolthole 56. The bolthole 56 can be properly screwed into the external screw 54 of above-mentioned connection end 53. Therefore, the end users can have different options of external screw 54 or quick connector 55 (note: the existing sprinkler systems in the market are available with both structures) as per the configurations of the connection ends of water pipes and sprinklers.

Figure 3:
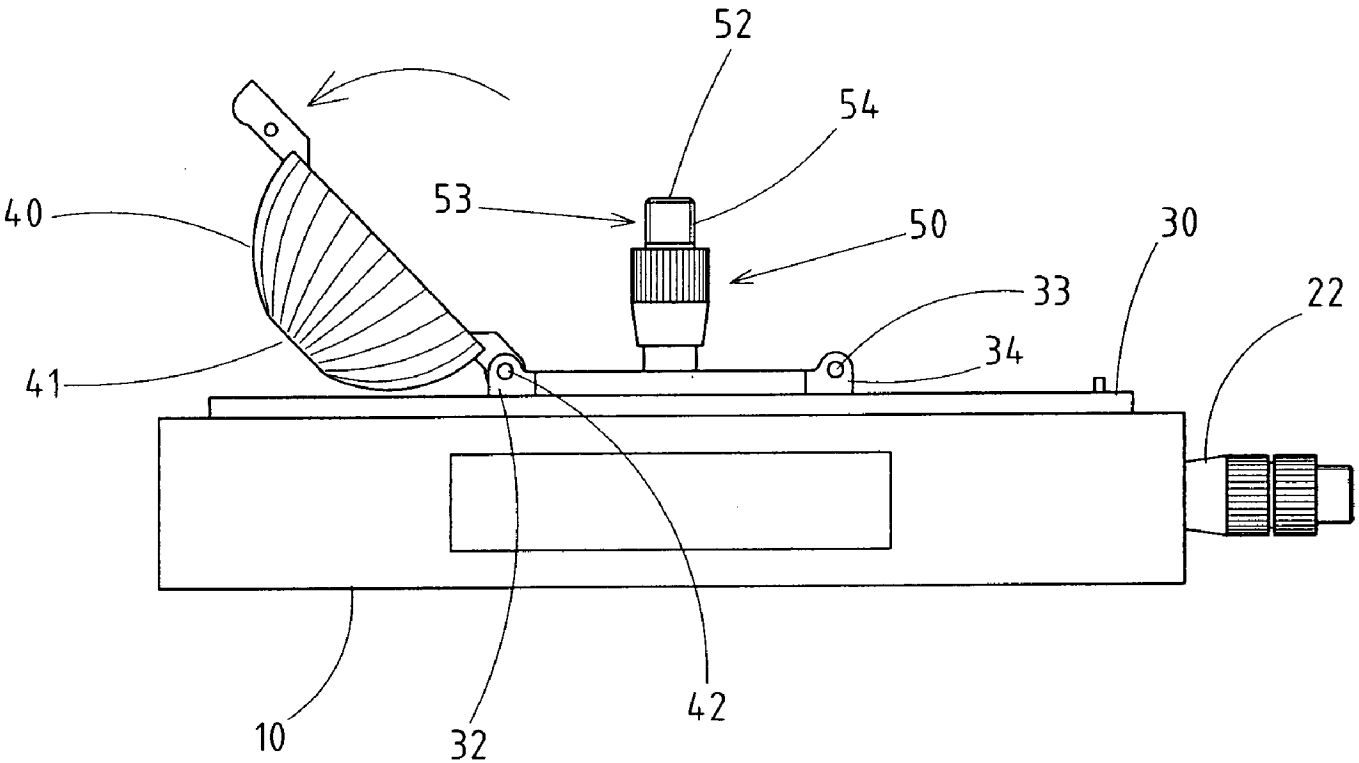
FIG. 3 shows a side elevation view of the opening of the outlet limit base.

Of which, the outlet limit base 40 can be designed with an openable structure, i.e. the outlet limit base 40 is provided with a pin joint end and a locking end. In detail, a pivot set 42 is provided at one end of the outlet limit base 40, and a pin joint seat 32 is provided at the center of the swing frame 30. Meanwhile, two spacing convex sheets 43 will take shape at the other end of the outlet limit base 40, while two projections 44 are placed at the outer flank of two convex sheets 43 such that the convex seat 34 of locking slot 33 can be mounted opposite to the swing frame 30. Thereby, in the case of a closing state of outlet limit base 40, the projections 44 of two convex sheets 43 can insert into the locking slot 33 of the convex seat 34, which can enable the outlet limit base 40 to be closed securely. Also, to open the outlet limit base 40, just press two convex sheets 43 oppositely so as to separate the projection 44 from the locking slot 33. So, the outlet limit base 40 can be opened (as shown in FIG. 3) for check purpose.

Based upon the aforementioned structure and configuration, the present invention has offered several options for the connection base 50 of the pipe reel as detailed below.

Figure 4:
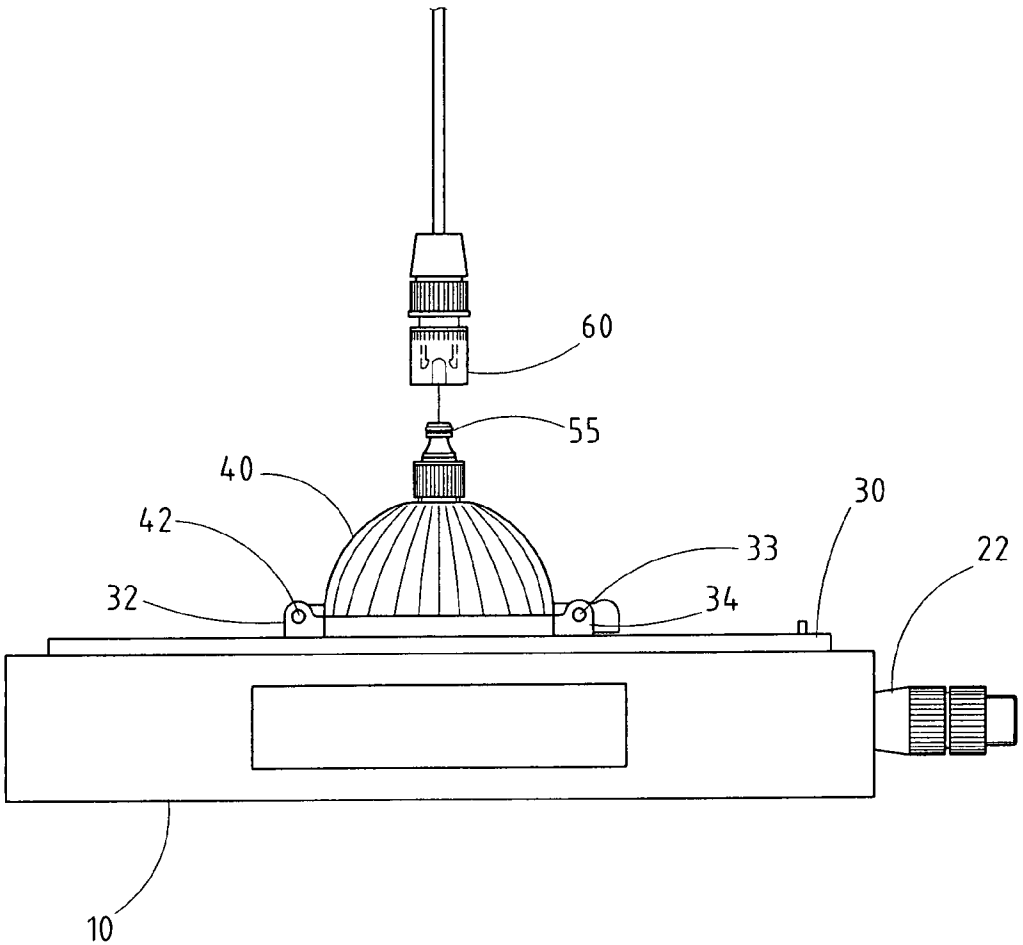
FIGS. 4–6 show side elevations views of the assembly of the present invention.

As shown in FIG. 4, the connection end 53 of the connection base 50 can be designed to connect the water pipe head 60 of the water supply system.

Figure 5:
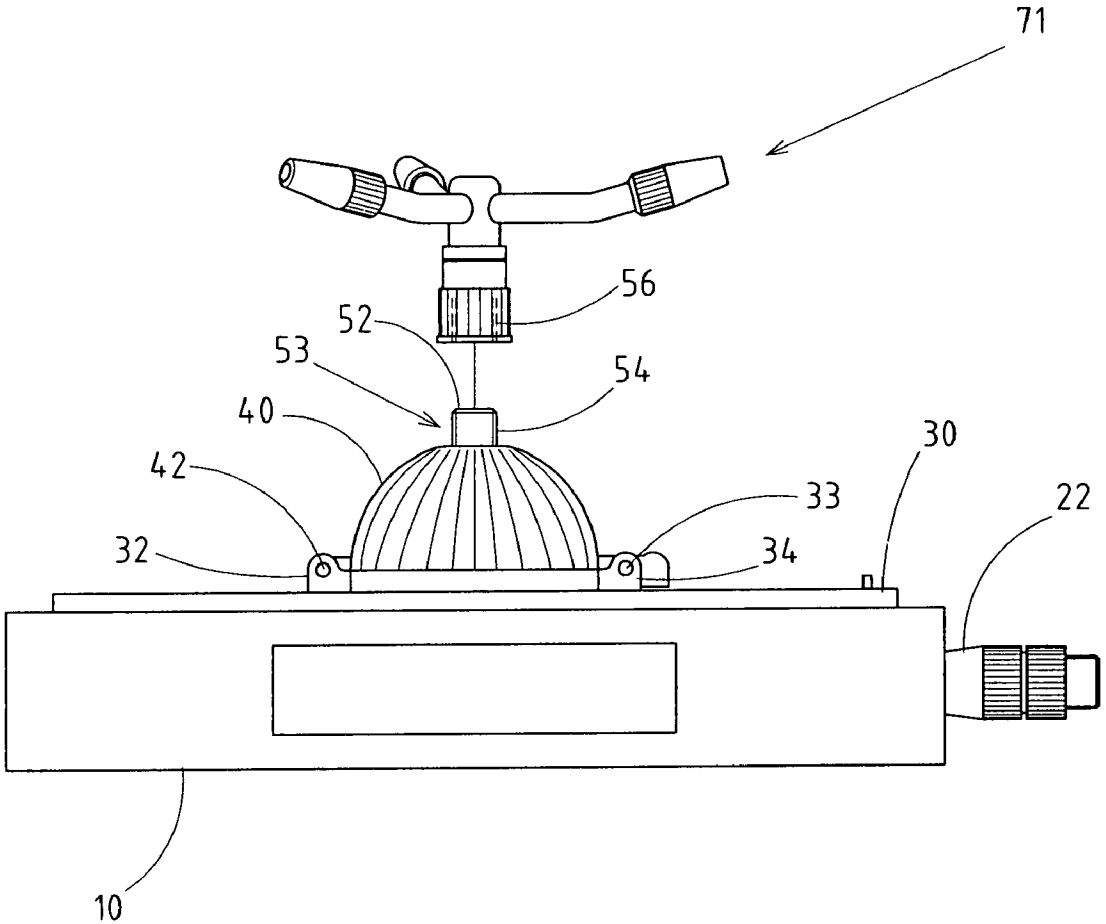
Figure 6:
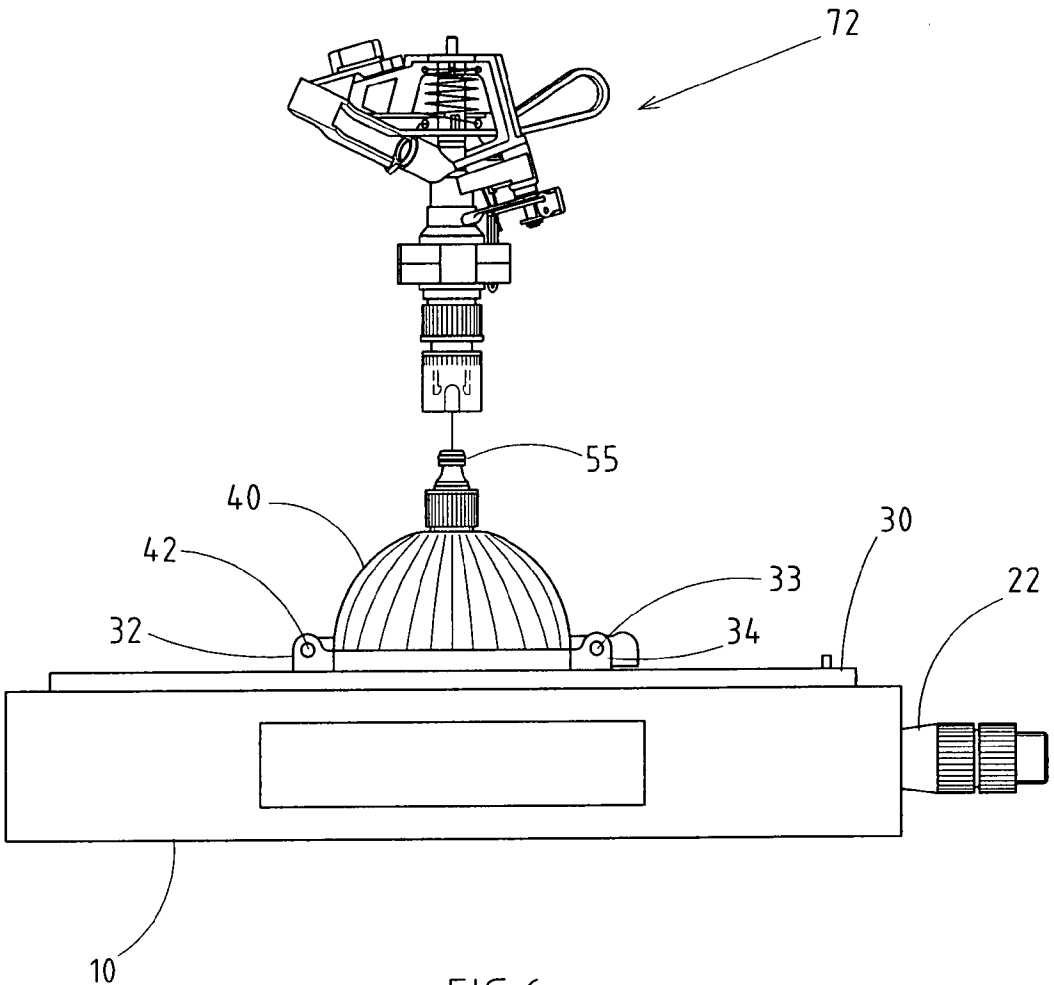

As shown in FIGS. 5–6, the connection end 53 of the connection base 50 can be designed for the connection of sprinklers 71, 72, wherein the main frame 10 can serve as a baseboard. And, the second end 22 of the water pipe 20 can also be used as an inlet end, i.e. the second end 22 can be connected to the hydrant for incoming water, then the sprinklers 71, 72 can spray the water accordingly.

I claim:

1. A reel comprising:

a main frame provided with a pipe groove to accommodate a water pipe wrapped onto a swing frame, a first end of the water pipe being placed at a central outlet of a swing frame, and a second end of the water pipe being placed at a preset cross groove at one side of the main frame;

an outlet limit base provided at the central outlet of the swing frame, a cross-hole being available for connection;

a connection base provided within the outlet limit base, an inner end being connected to the first end of the water pipe, and an outer end penetrating the cross-hole of the outlet limit base to give shape of a convex of a preset length, said convex being provided with a connection end, which is available with the configurations of water pipe head and sprinkler connector for multi-functionality.

2. The reel defined in claim 1, wherein said outlet limit base has an openable structure, the outlet limit base being comprised of a pin joint end and a locking end.

3. The reel defined in claim 1, wherein said connection base has a L-type pipe form.

4. The reel defined in claim 1, wherein the connection end of said connection base has configurations of an external screw or internal screw.

5. The reel defined in claim 1, wherein the connection end of said connection base has a configuration of a quick connector.

* * * * *